US007987601B2

(12) United States Patent
Nakamura

(10) Patent No.: US 7,987,601 B2
(45) Date of Patent: Aug. 2, 2011

(54) FOLDING TOOL

(75) Inventor: Seiichi Nakamura, Seki (JP)

(73) Assignee: Mentor Group, L.L.C., Oregon City, OR (US)

( * ) Notice: Subject to any disclaimer, the term of this patent is extended or adjusted under 35 U.S.C. 154(b) by 596 days.

(21) Appl. No.: 12/092,720

(22) PCT Filed: Jul. 12, 2006

(86) PCT No.: PCT/JP2006/313832

§ 371 (c)(1),
(2), (4) Date: May 6, 2008

(87) PCT Pub. No.: WO2007/055049

PCT Pub. Date: May 18, 2007

(65) Prior Publication Data

US 2009/0119925 A1 May 14, 2009

(30) Foreign Application Priority Data

Nov. 11, 2005 (JP) ..... 2005-326879
Jul. 12, 2006 (JP) ..... 2006-191153

(51) Int. Cl.
*B26B 1/04* (2006.01)

(52) U.S. Cl. ..... 30/161; 30/158

(58) Field of Classification Search ..... 30/158, 30/159, 160, 161, 153, 155, 330, 156, 157, 30/331
See application file for complete search history.

(56) References Cited

U.S. PATENT DOCUMENTS 6,434,831 B2 * 8/2002 Chen ..... 30/161
6,553,672 B2 4/2003 Glesser et al.
7,437,822 B2 * 10/2008 Flagg et al. ..... 30/161

OTHER PUBLICATIONS

International Preliminary Report on Patentability and Written Opinion for PCT/JP2006/313832 May 2008.

* cited by examiner

*Primary Examiner* — Stephen Choi
(74) *Attorney, Agent, or Firm* — Hancock Hughey LLP

(57) ABSTRACT

The folding tool has one side-plate (1*a*) and the other side-plate (1*b*). A part of the rear side of the other side-plate (1*b*) or an arm-like plate (2) attached as a separate body is used as an inwardly pressing member, and a projection (3) is provided at the head of the arm-like plate (2). The base end of the body (5) having at its end a rear recess (6) is foldably pivotally attached by means of a support shaft (4) to the base ends of both the one side-plate and the other side-plate. The projection (3) and the recess (6) of the body (5) are engaged with and locked to each other.

10 Claims, 5 Drawing Sheets

FOLDING TOOL

TECHNICAL FIELD

The present invention is a folding device having a mechanism to safely and securely fasten as well as easily release an opening and closing lock provided in a pocketknife or the like.

BACKGROUND OF THE INVENTION

In a conventional lockable pocketknife, a back spacer is rotatably attached through a spindle to the back between a pair of side plates, a blade body base end is foldably attached through a spindle to the tip portion between both side plates, and a convex portion of the end of the back spacer and an end portion dorsal concave portion engage. When closing the open blade body, the tip had to be held with the fingers of one hand while closing with the other hand in order to release the lock of the portion at which the convex portion of the end of the back spacer and the end portion dorsal concave portion of the blade body engage.

Additionally, a pocket knife is formed such that one of its pair of side plates is made into a long arm-shaped spring and is slightly bent in the direction in which a pushing pressure applies to the blade body when the knife is closed. A slight bending occurs, and the tip of the arm-shaped plate and the locking surface of the ventral portion of a tang of the blade body are fastened when the blade body of the knife is open. When closing the blade body, the blade end portion of the blade body is in the line of rotation; and when releasing the lock, the arm-shaped plate has to be pushed with one hand to release, and the blade body has to be closed with the other hand, which is extremely dangerous. Besides, there are shortcomings such as when a strong pushing pressure is applied toward the back of the blade body, a strong pushing force is applied to the arm-shaped plate of the side plate, causing bending and shortening the length of the arm-shaped plate; and that the pushing force on the locking portion of the blade body tang weakens, eliminating the locking function. There are also locking methods whereby a locking portion is attached toward the back of the knife such that fingers are not positioned in the line of rotation of the blade end portion of the blade body when closing the blade body; however, the strength of the arm shape is considered inadequate for the pushing pressure for closing the blade body.

SUMMARY OF THE INVENTION

The object of the present invention can be achieved according to a folding tool characterized in having one side plate (1*a*) and another side plate (1*b*); and in that an arm-shaped plate (2) with a pushing pressure is provided using a portion of a dorsal side of said other side plate (1*b*) or provided at an inner side which is separately attached; there is a convex portion (3) at a tip of said arm-shaped plate; a base end of blade body (5) to which a dorsal concave portion (6) is attached is axially attached so as to be foldable to an end portion of base ends of said one side plate and said other side plate through a spindle (4); and said concave portion (6) of the end portion of the main body (5) and said convex portion (3) engage and lock.

DETAILED DESCRIPTION OF THE ILLUSTRATED EMBODIMENTS

Conventionally, there have been a number of proposals for improved technologies. While safely lockable mechanisms have been proposed, fingers are required to be placed in the line of rotation of the blade end portion when being closed, which is unfavorable from the viewpoint of safety and lacks adequate strength; consequently, such proposals are inadequate from the viewpoint of safety. It is an aim of the present invention to solve these shortcomings. These sorts of problems are not limited to knives, but are common to key holders, small tool holders for screwdrivers, saws, and the like.

The present invention is constituted as described above, and has the effect to enable releasing the lock in a safe position without holding the main body and a handle when folding and without positioning fingers in the line of rotation of the blade end portion of the blade body as was conventional.

Also, when a strong pushing pressure is applied from the rear of the main body, a pulling pressure is produced in the convex portion of the base end of the arm-shaped plate of the side plate. With conventionally produced side plates, the arm-shaped plate is provided at the ventral portion, and the end portion ventral locking portion of the blade body and the engaged liner lock apply a pushing pressure on the arm, decreasing the lock functionality of the arm; however, the present invention has the effect of retaining the strength of the lock functionality of the arm and of furthermore enabling the blade body to be opened smoothly like conventional liner locks.

As with knifes, the present invention can safely store keys, saws, and various types of tools, releasing them for use according to need.

While what is called the main body in the present invention means, of course, the blade body of a knife, it can also be applied to a saw or a screwdriver in a small tool holder as well as a key in a key holder in addition to the blade body of a knife.

Although the knife of the present invention is applicable to knives in general including pocketknives, carving knives, and the like; among these, it is particularly well suited for application to pocketknives.

Although a metal such as stainless steel, titanium, and aluminum may be preferably used for the material of the one side plate as well as for the material of the opposite side plate if the arm-shaped plate is attached separately, a plastic including reinforced plastic, wood including reinforced wood, and the like may also be applied.

A detailed description is provided below using a pocketknife as an example. Of course, the present invention is not limited to the example below. If the blade body is replaced with a screwdriver, a saw, or the like, a description of some other small tool may be substituted. The arm-shaped plate may be composed from a portion of the other side plate, of course, as shown in FIG. 1, but may be provided separately from the other side plate and attached through a spindle as well.

Figure 1:
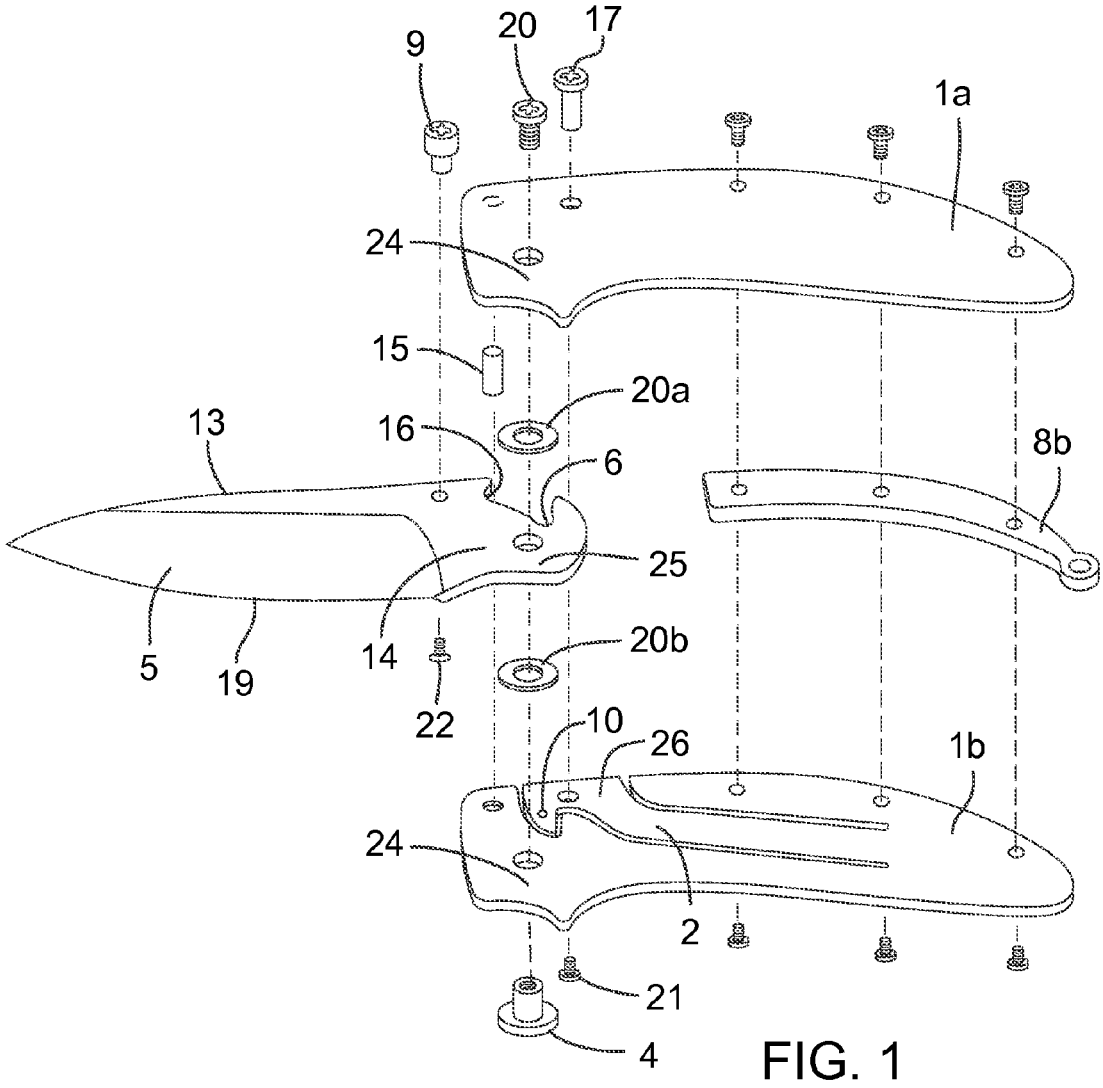
FIG. 1 is a perspective exploded view showing the constituent parts of the pocketknife of the present invention.

FIG. 1 is a view showing the components constituting the pocketknife of the present invention.

Figure 2:
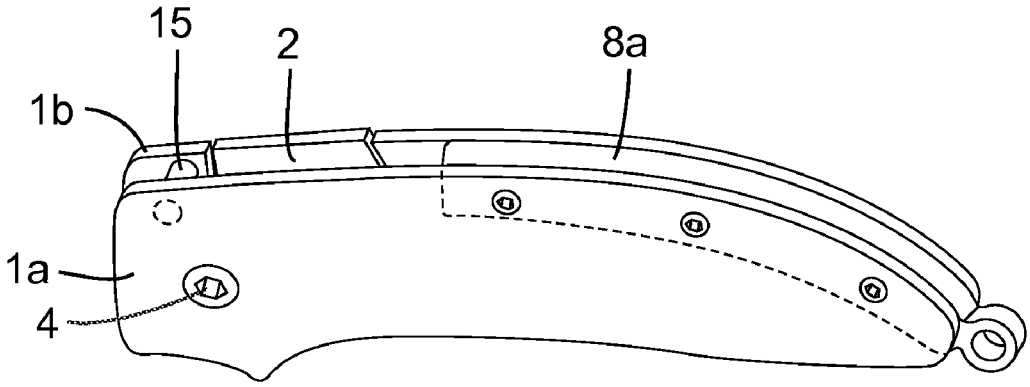
FIG. 2 is view perspective showing a state where the blade body storage space of the present invention is provided.

FIG. 2 is a view showing a state with a back spacer (8*a*) attached to a pair of side plates (1*a*, 1*b*), providing a storage space for a blade body (5).

The opening and closing procedure is described below in [reference to] FIG. 3 through FIG. 8.

Figure 3:
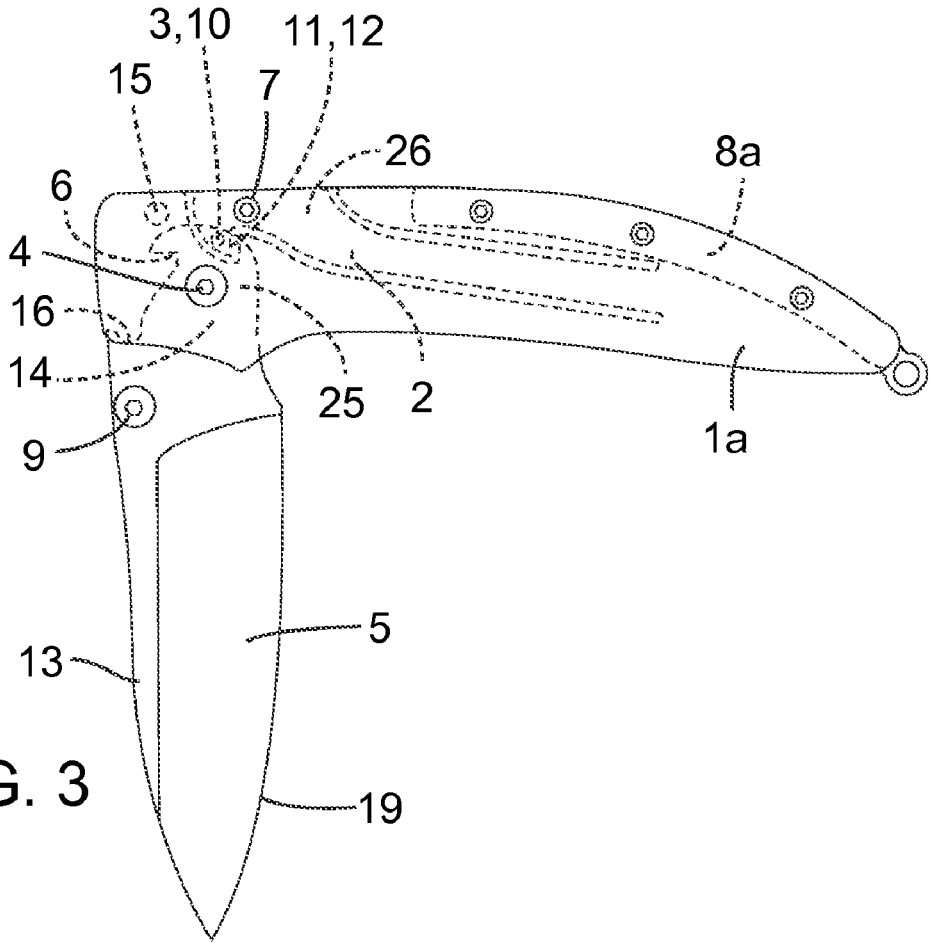
FIG. 3 is an elevation view showing an intermediate state on the way to the complete opening of the blade body of the present invention.

FIG. 3 is a view showing a state where a finger rest (9) of the blade body (5) has been rotated by the thumb, opening the blade body (5) to approximately 90 degrees. The drawing shows the blade body (5) in a completely open state with a steel ball (10) attached to a side plate arm (2) being in a displaced state, released from a blade body locking concave portion (18*a*) of a blade body tang (14).

Figure 4:
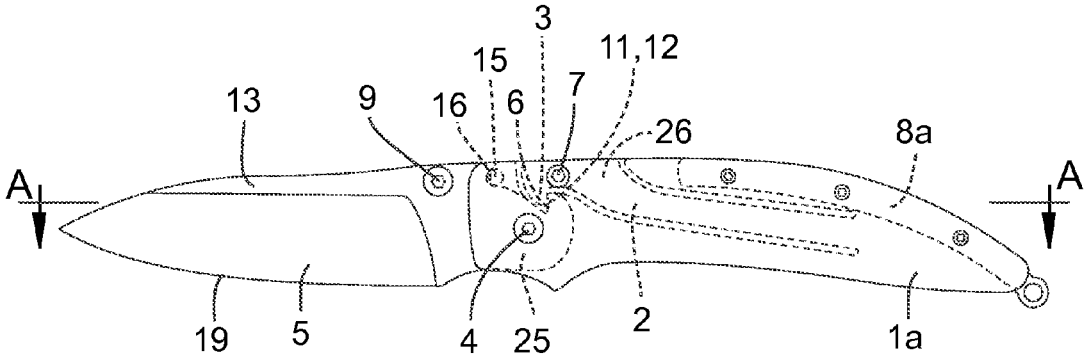
FIG. 4 is an elevation view showing a state with the blade body of the present invention completely open.

In FIG. 4, by further opening with the finger rest (9) until a stop pin locking portion (16) of the blade body tang (14) comes into contact with a stop pin (15), a convex portion (3) of the base end of the arm-shaped plate engages with an end portion dorsal concave portion (6) of the blade body (5), which thereby locks securely. At this time, a contact surface (11) of the convex portion of the arm-shaped plate base end and a blade body end portion dorsal concave portion contact surface (12) mesh together due to the pushing pressure of the arm-shaped plate.

A position to provide a so-called arm-shaped base end (26) in the present invention may be, as shown in FIG. 1, at a back portion of the other side plate (1*b*), forming the other side plate (1*b*) discontinuous, or may be at an inner side than the back portion of the other side plate (1*b*), forming the other side plate (1*b*) continuous. The latter is more preferable from a viewpoint of strength. Also in the case where the arm plate (2) is separately attached, either of the case where the other side plate (1*b*) is continuous as mentioned above or the case where it is discontinuous will do. From the viewpoint of strength, the case where the other side plate (1*b*) is continuous is more preferable.

Figure 5:
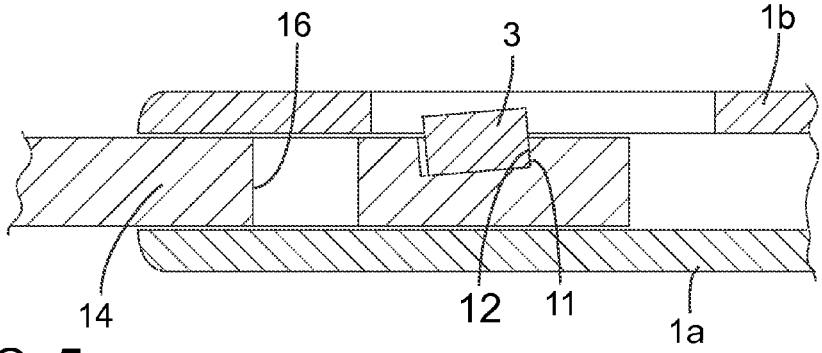
FIG. 5 is an enlarged cross sectional view taken along the line A-A of FIG. 4.

FIG. 5 is an enlarged view of the end surface of FIG. 4 along the line A-A of FIG. 4.

Figure 6:
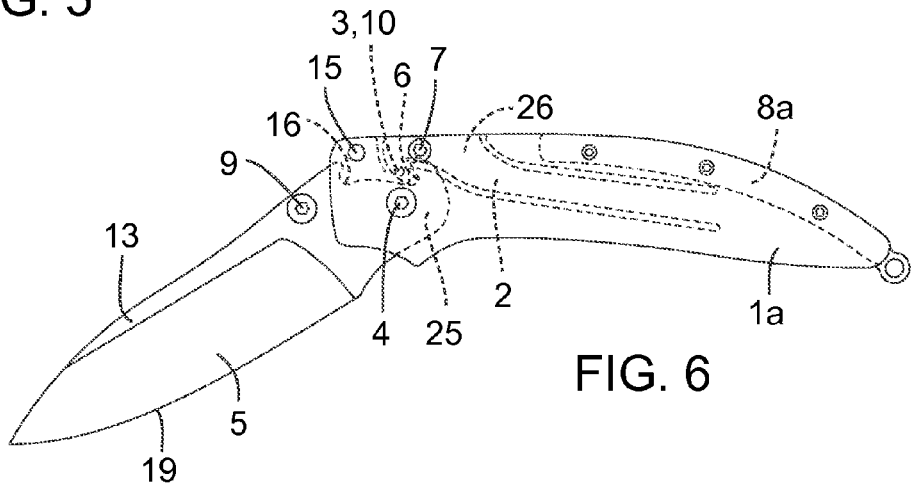
FIG. 6 is an elevation view showing an intermediate state on the way to the closing of the blade body of the present invention.

FIG. 6 is a view showing the blade body (5) in a partially closed state.

By pressing a lock release button (7), the meshing portion of the arm-shaped plate base end convex portion contact surface (11) is released from the blade body end portion dorsal concave portion contact surface (12), resulting in a movement space for the protruding portion of the steel ball (10) so that a blade body spine (13) can be pressed with a slight force to begin rotation of the blade body (5) around the center of a spindle (4).

Figure 7:
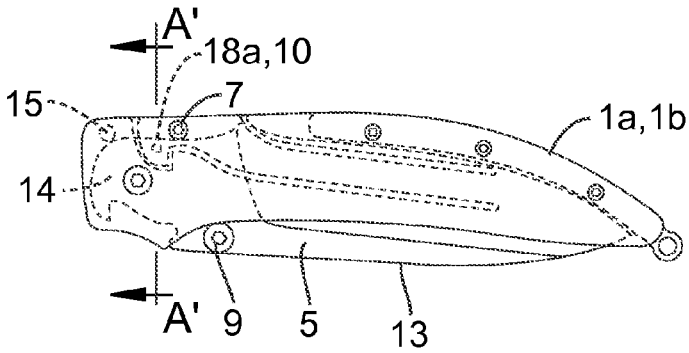
FIG. 7 is an elevation view showing a state where the blade body of the present invention is closed.

FIG. 7 is a view showing the blade body (5) in a completely closed state. By pressing the blade body spine (13) to cause rotation around the center of the spindle (4) and closing until the finger rest (9) comes into contact with the side plate (1*a*), meshing occurs due to the blade body locking concave portion (18*a*) of the blade body tang (14), so that the blade body (5) can be safely maintained without readily opening.

Figure 8:
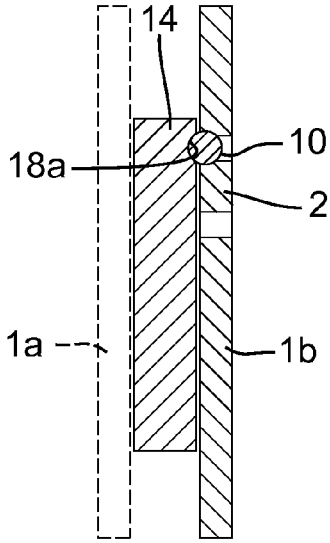
FIG. 8 is an enlarged cross sectional view taken along the line A'-A' of FIG. 7.

FIG. 8 is an enlarged view of the end face A'-A' of FIG. 7.

Figure 9:
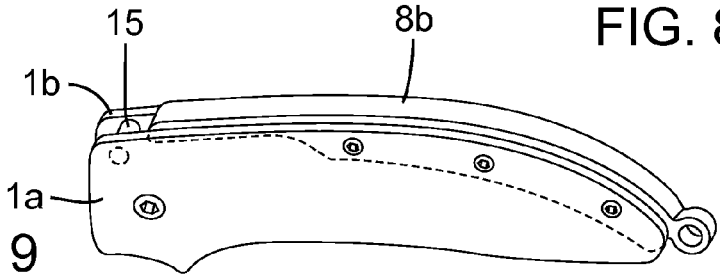
FIG. 9 is a perspective view of a state with a long back spacer assembled in the present invention.

FIG. 9 is another example of embodiment according to the present invention, in which the knife back spacer (8*b*) of the folding knife of FIG. 2 is lengthened.

Figure 10:
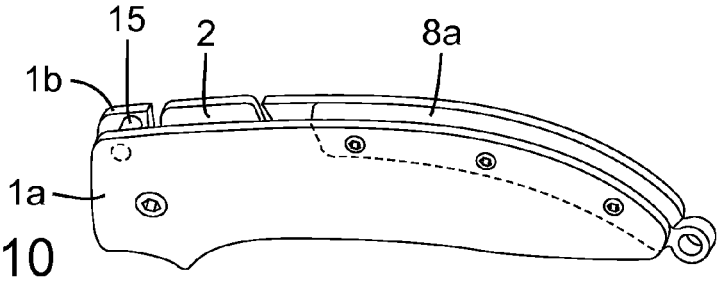
FIG. 10 is a perspective view showing example (1) whereby a lock can be released without a release button.

FIG. 10 is a view showing an example where the shape of the arm-shaped plate (2) is raised in the dorsal direction.

Figure 11:
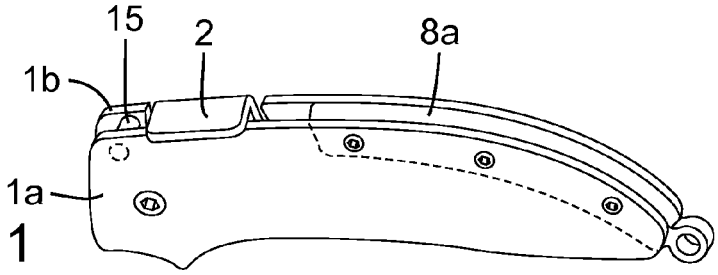
FIG. 11 is a perspective view showing example (2) whereby a lock can be released without a release button.

FIG. 11 is a view showing an example where the shape of the arm-shaped plate (2) is lengthened and bent inward.

Figure 12:
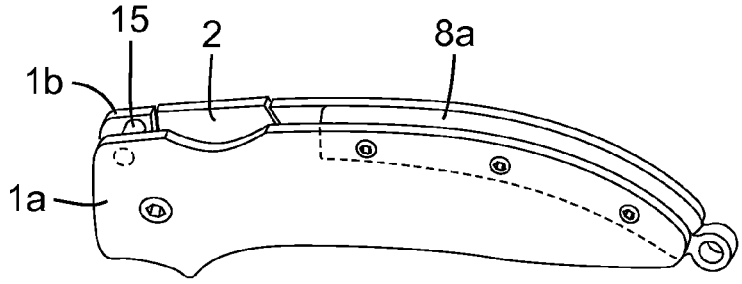
FIG. 12 is a perspective view showing example (3) whereby a lock can be released without a release button.

FIG. 12 is a view showing an example in which a notched portion is provided in the other side plate (1*b*), facilitating the operation of the arm-shaped plate (2) in order to make the operation of the arm-shaped plate (2) easier.

Figure 13:
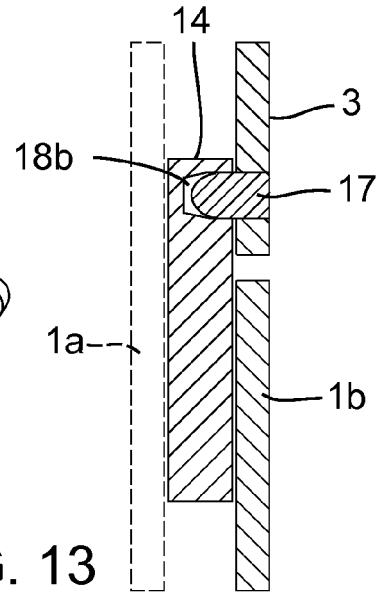
FIG. 13 is a cross sectional view showing a state of the present invention where the blade body is securely fastened and does not readily open.
Figure 14:
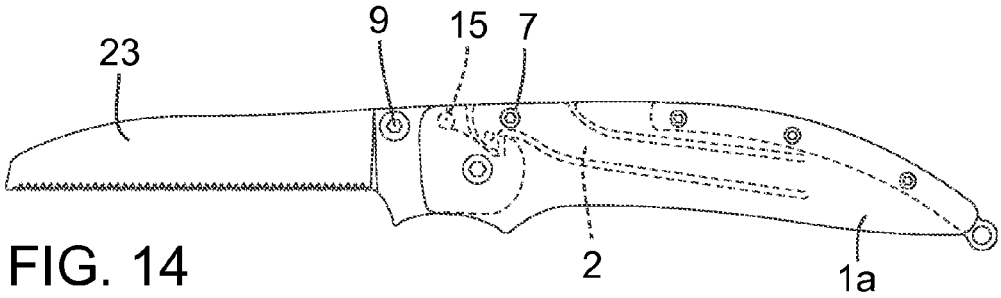
FIG. 14 is an elevation view of an example with a saw attached to the present invention.
Figure 15:
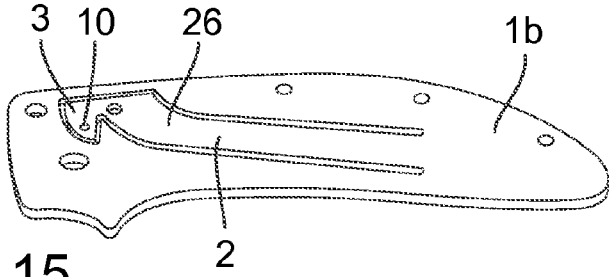
FIG. 15 is a perspective view showing an example of the side plate.

In FIG. 13, a columnar protruding portion (17) is provided at the arm-shaped plate base end convex portion (3), and the blade body locking concave portion (18*b*) of the blade body tang (14) is deepened; while this is to prevent easy opening when the blade body (5) is closed and securely fastened, the lock can be easily released by pressing the lock release button (7). (Refer to FIG. 7 and FIG. 8.)

While the present invention may be favorably applied to pocketknives, it may also be applied over a wide range including knives such as carving knives, kitchen knives, chisels, and the like, of course, as well as office implements, tools, keys, household products, cosmetic products, and the like.

Because the technology of the present invention is a lock which can be released safely and easily, it can be preferably applied not only to knives, particularly pocketknives, but also over a wide range including office implements, keys, household products, cosmetic products, and the like.

EXPLANATION OF REFERENCE NUMBERS USED HEREIN

1*a*: side plate
1*b*: side plate
2: arm-shaped plate
3: arm-shaped plate base end convex portion
4: spindle
5: blade body
6: blade body dorsal concave portion
7: lock release button
8*a*: back spacer
8*b*: back spacer
9: finger rest
10: steel ball
11: arm-shaped plate convex portion contact surface
12: blade body dorsal concave portion contact surface
13: blade body spine
14: blade body tang
15: stop pin
16: stop pin locking portion
17: columnar protruding portion
18*a*: blade body locking concave portion
18*b*: blade body locking concave portion
19: blade end portion
20: spindle set screw
21: lock release button set screw

22: finger rest set screw
23: saw
24: side plate base end
25: blade body base end
26: arm-shaped plate base end

The invention claimed is:

1. A folding tool, comprising:

a first side plate and a second side plate, said first and second side plates defining a storage space therebetween and said first and second side plates having a dorsal portion;

an elongate plate formed in the dorsal portion of one of said first or second side plates, said elongate plate provided with a pushing pressure toward said storage space and having a tip with a convex portion;

a blade foldably attached between the first and second side plates at a tang portion of said blade, and said blade foldable between a first state in which the blade is stored in the storage space, and a second state in which the blade is in an open state, said blade having a concave portion on the tang portion of said blade that engages with the convex portion of the elongate plate when the blade is in the open state to lock said blade in said open state, wherein when said blade is locked in the open state and pressure is applied to said blade to fold it toward the first state, the engagement between the convex portion of the elongate plate and the concave portion of the tang portion of the blade causes tension to be applied to said elongate plate in a direction that is substantially parallel to the longitudinal axis of said elongate plate.

2. The folding tool according to claim 1 wherein the convex portion of the elongate plate defines a hook that is cooperatively shaped with the concave portion of said blade so that the hook engages said concave portion.

3. The folding tool according to claim 2 wherein the elongate plate is biased toward said storage space.

4. The folding tool according to claim 3 wherein the elongate plate defines a spring arm that automatically locks the blade in the open state when said blade is folded from the first state to the second state.

5. The folding tool according to claim 1 including a lock release button on the elongate plate.

6. The folding tool according to claim 5 wherein said blade is foldable from the second state to the first state by pressing the lock release button to unlock the blade.

7. The folding tool according to claim 1 wherein the elongate plate is an integral part of the side plate.

8. The folding tool according to claim 1 wherein the elongate plate is attached to the side plate.

9. The folding tool according to claim 1 including a stop pin extending between said first and second plates.

10. The folding tool according to claim 1 wherein the elongate plate exerts pressure on the blade when the elongate plate is in the first state to retain the blade in the first state.

* * * * *